United States Patent [19]

Litt et al.

[11] 4,368,574

[45] Jan. 18, 1983

[54] METHOD OF ASSEMBLING A RELAY

[75] Inventors: Ferdinand Litt, Bischheim; Daniel Neff, Reichsett; Gilbert Schneider, Mundelsheim; Roger Sprauel, Strasbourg; Guy Wotling, Illkirch-Graffenstaden, all of France

[73] Assignee: Societe Anonyme dite: la Telephonie Industrielle et Commerciale - TELIC, Strasbourg, France

[21] Appl. No.: 147,787

[22] Filed: May 8, 1980

[30] Foreign Application Priority Data

May 9, 1979 [FR] France ..... 79 11717

[51] Int. Cl.[3] ..... H01H 11/00

[52] U.S. Cl. ..... 29/602 R; 29/467; 29/622

[58] Field of Search ..... 29/602 R, 622, 467; 335/202, 187, 120, 160

[56] References Cited

U.S. PATENT DOCUMENTS

| | | | |
|---|---|---|---|
| 3,711,801 | 1/1973 | Bloch | 335/187 X |
| 3,916,511 | 11/1975 | Brehe | 29/467 X |
| 4,033,029 | 7/1977 | Wolfe | 29/622 |
| 4,195,275 | 3/1980 | Kraess et al. | 335/120 |
| 4,220,939 | 9/1980 | Grable | 29/622 X |

*Primary Examiner*—Carl E. Hall

*Attorney, Agent, or Firm*—Sughrue, Mion, Zinn, Macpeak & Seas

[57] ABSTRACT

A method of assembling a multiple electromagnetic relay which includes a common base (1) and a plurality of springs (3) each associated with a magnetic armature (4) which co-operates with the magnetic circuit (12). According to said method, springs (5) are held stationary on the base (1), then, by means of a first moving tool (10) the armatures are brought against a first surface (14*a*) of a limit plane (14), then the magnetic circuits (12) are set in plane and positioned by means of a second moving tool (16) against a second surface (14*b*) of the limit plane (14). Then, the various components are held stationary by means of a resin.

2 Claims, 2 Drawing Figures

METHOD OF ASSEMBLING A RELAY

BACKGROUND OF THE INVENTION

In U.S. Pat. No. 4,195,275 of Mar. 25, 1980 entitled "A multiple electromagnetic relay", there is described a multiple electromagnetic relay which includes a plurality of individual relays disposed on a base. Each individual relay mainly comprises a stand, a magnetic circuit constituted by a pole piece and a winding, and a moving spring-carrying armature which co-operates with the pole piece.

Proper operation of the individual relay depends in particular on the value of the air gap between the pole piece and the armature.

Up till now, said air gap is obtained as a result of stacking the component parts such as the stand, the pole piece, the armature, the armature stop and the spring carrier.

The air gap tolerance is a function of the sum of the tolerances allowed for the dimensions of the abovementioned parts. To obtain an air gap of acceptable size, care must be taken when adjusting the size of said parts. This increases the cost of the relay. If, in contrast, relatively large variations in the value of the air gap are tolerated, allowance must be made for an increase in the value of the relay control current.

One aim of the invention is to define a method of assembling a relay in such a way as to guarantee a particular size of air gap of the relay without requiring an increase in production accuracy of its component parts.

SUMMARY OF THE INVENTION

The invention provides a method of assembling a multiple electromagnetic relay formed by a plurality of individual relays each of which comprises a magnetic circuit equipped with a winding, a magnetic armature, and a moving spring which includes a contact, said method comprising the following operations:

the moving springs of the individual relays are assembled together with their respective magnetic armatures by moulding so as to constitute a single spring-carrier part;

said part is laid on a base and is held stationary with resepect thereto;

by means of a first moving tool, the springs of said part are moved so as to bring the armature up to a first surface of a limit plane in the position which they occupy when the windings of the individual relays are in energized condition;

the magnetic circuits of the individual relays are placed on the base and, by means of a second moving tool, they are brought up to the other surface of the limit plane; and a settable resin is cast into the base so as to trap the foot of the spring-carrier part and the bases of the magnetic circuits.

Preferably, a third moving tool is used to hold the tops of the magnetic circuits stationary when the resin is cast.

The method of the invention will be made clearer by the following description, given by way of example with reference to the accompanying drawing.

DESCRIPTION OF THE PREFERRED EMBODIMENT

Figure 1:
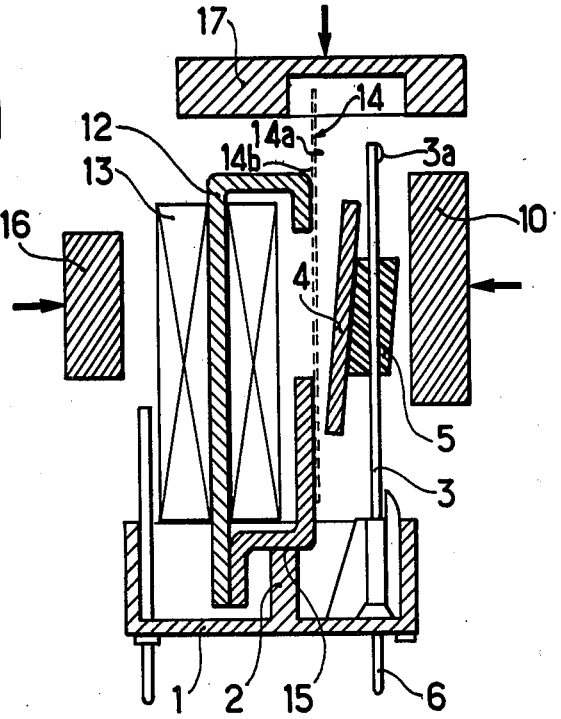
FIGS. 1 and 2 are sectional views which illustrate the various phases of the method.
Figure 2:
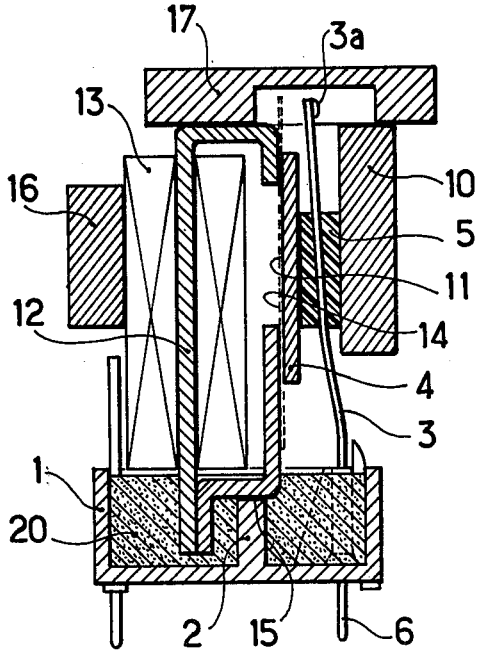

FIG. 1 illustrates a transverse cross-section through one of the individual relays of a multiple electromagnetic relay.

In FIG. 1, reference 1 designates the base of a multiple electromagnetic relay. Said base is a hollow parallelepiped reinforced by a central rib 2.

The various moving parts of the individual relays include a spring blade 3 having a contact 3*a*, and a magnetic armature 4 made fast with the spring by an insulating component 5. These components are assembled together by moulding so as to constitute a single spring support part which is placed in the base and is stationary with respect thereto. This is easily achieved by plugging the springs in holes in the base from which they protrude in the form of pins.

A moving tool 10 moves the plate support part so as to bring the armature up to a first surface 14*a* of a limit plane 14 which corresponds to the positions of the armatures when the relays are in the operated position. Said plane may either be provided in physical form, as shown, in the form of a rigid but thin plane sheet, or alternatively the limit plane may be no more than a geometrical indication which is implemented indirectly, see below.

The magnetic circuits 12 equipped with their windings 13 are placed in the base.

Advantageously, they press against a reference plane 15 constituted by the top of the rib 2.

A moving tool 16 moves them so as to bring them against the surface 14*b* of the limit plane 14.

A moving tool 17 with a cavity for accommodating the ends of the springs then presses against the tops of the magnetic circuits so as to block the assembly in position.

A resin is then cast within base 1 and when it hardens it fixes the various components of the relay.

The tools and the limit plane (if provided in physical form) are then removed.

If the limit plane is not provided in physical form the tools must be made to move over precise distances, e.g. using a micrometer screw, but otherwise the method is identical.

The method of the invention provides relays with constant and repetitive characteristics. Tolerances and the value of the control currents can therefore be reduced. The size of the air gap is thus automatically adjusted during assembly without it being necessary to proceed with any subsequent air-gap adjusting steps.

We claim:

1. A method of assembling a multiple electromagnetic relay formed of a plurality of individual relays positioned side-by-side, each of said individual relays comprising a magnetic circuit member equipped with a winding, a magnetic armature, and a blade spring bearing a contact at a movable end thereof, said method comprising the following steps:

assembling the blade springs of the individual relays together with their respective magnetic armature by moulding each armature to each spring so as to constitute a single spring-carrier part;

fixing the end of each blade spring remote from the contact within a hollow base and maintaining it stationary with respect thereto;

moving, by means of a first moving tool, the blade springs of said parts so as to bring the armatures, respectively, of said parts up to a first limit plane at right angles to the longitudinal axis of the base and in a position which they occupy when the individual relays are under winding energized condition;

placing the magnetic circuit members of the individual relays in upright position with one end thereof within said base and by means of a second moving tool, moving said magnetic circuits laterally to one side thereof to bring one side thereof up to a second limit plane parallel to said first limit plane; and casting a settable resin into the base so as to trap the foot of the spring-carrier parts and the bases of the magnetic circuit members so as to accurately define the same air gap when the blade springs are relaxed and the armature separated from the circuit members for all of said relays irrespective of tolerance variations for both said spring-carrier parts and said magnetic circuit members.

2. The method as claimed in claim 1, wherein said base comprises an upwardly open parallelepiped including a vertical rib projecting upwardly from the bottom of the base, and wherein said magnetic circuit member is positioned such that the base of the magnetic circuit member abuts the upper end of the rib to define the extent of projection of the base of said magnetic circuit member for the individual relays within the hollow base, and wherein said second moving tool acts against the side of the circuit member opposite that facing the second limit plane to move the base of said magnetic cirucit member laterally across the rib to bring one side of the magnetic circuit member up to the second limit plane.

* * * * *